US007296447B2

(12) United States Patent
Priest et al.

(10) Patent No.: US 7,296,447 B2
(45) Date of Patent: Nov. 20, 2007

(54) VENDING MACHINE LOCK ASSEMBLY

(75) Inventors: William L. Priest, West Hartford, CT (US); Stephen A. Peterson, Noblesville, IN (US); Aaron McKibben, Indianapolis, IN (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 11/232,953

(22) Filed: Sep. 23, 2005

(65) Prior Publication Data

US 2006/0185407 A1 Aug. 24, 2006

Related U.S. Application Data

(60) Provisional application No. 60/655,724, filed on Feb. 24, 2005.

(51) Int. Cl.
*E05B 13/00* (2006.01)

(52) U.S. Cl. ..... 70/208; 70/140; 70/210; 70/223; 70/257; 70/278.7; 70/283; 292/251; 292/336.3; 292/359; 292/DIG. 31

(58) Field of Classification Search ..... 70/208, 70/210, 218, 223, 257, 140, 278.7, 277, 283, 70/279.1; 292/336.3, DIG. 31, 251, 359, 292/DIG. 25

See application file for complete search history.

(56) References Cited

U.S. PATENT DOCUMENTS 1,378,200 A * 5/1921 Stolberg ..... 200/42.01
1,466,537 A * 8/1923 McCarthy ..... 70/210
3,834,198 A * 9/1974 Wiczer ..... 70/208
4,015,456 A 4/1977 Moberg
4,058,992 A 11/1977 Nielsen, Jr.
4,161,870 A 7/1979 Barnes
4,167,104 A * 9/1979 Bond ..... 70/208
4,807,454 A 2/1989 Sengupta et al.
4,811,580 A * 3/1989 Jang ..... 70/218
4,848,115 A * 7/1989 Clarkson et al. ..... 70/276
5,083,122 A * 1/1992 Clark ..... 340/5.22
5,345,797 A * 9/1994 Hayes ..... 70/218
5,611,223 A * 3/1997 Spitzer ..... 70/58
5,757,616 A * 5/1998 May et al. ..... 361/683
5,767,616 A * 6/1998 Kim ..... 313/456
5,791,176 A 8/1998 Montesinos Alonso
5,813,257 A 9/1998 Claghorn et al.
5,819,563 A 10/1998 Bianco (Continued)

*Primary Examiner*—Lloyd A. Gall
(74) *Attorney, Agent, or Firm*—Pillsbury Winthrop Shaw Pittman LLP

(57) ABSTRACT

A wireless lock assembly includes a latch assembly that includes a wireless, electrically operated latching component, and a manually movable latching component. The wireless, electrically operated latching component is movable between activated and inactivated positions. The electrically operated latching component will remain in the activated position for a predetermined period of time, after which it will return to the inactivated position. The lock assembly also includes a handle assembly that is manually movable from a non-enabled position into an enabled position when the electrically operated latching component is moved to its activated position. When the handle assembly is in its enabled position, it can be manually moved so as to move the manually movable latching component from a locking condition to a releasing condition. The handle assembly can be manually moved from its non-enabled position to its enabled position by manual engagement and depression of an exposed surface portion thereof.

10 Claims, 11 Drawing Sheets

U.S. PATENT DOCUMENTS 6,125,673 A 10/2000 Luker
6,345,522 B1 2/2002 Stillwagon et al.
6,384,711 B1 * 5/2002 Cregger et al. ..... 340/5.65
6,422,049 B1 * 7/2002 Jenks ..... 70/208
6,434,985 B1 8/2002 Walmsley
6,442,983 B1 9/2002 Thomas et al.
6,474,119 B1 * 11/2002 Halvorson et al. ..... 70/208
6,490,896 B2 12/2002 Segawa
6,496,101 B1 12/2002 Stillwagon
6,591,644 B2 7/2003 Doerr et al.
6,668,606 B1 12/2003 Russell et al.
6,684,671 B2 2/2004 Beylotte et al.
6,705,136 B2 3/2004 Porter
6,718,806 B2 4/2004 Davis
6,747,631 B1 * 6/2004 Sakamaki et al. ..... 345/157
6,810,700 B2 11/2004 Okuno
6,840,072 B2 1/2005 Russell et al.
6,867,685 B1 * 3/2005 Stillwagon ..... 340/5.64
2003/0140665 A1 * 7/2003 Szuminski et al. ..... 70/257
2004/0007032 A1 1/2004 Davis
2004/0172991 A1 9/2004 Forster et al.
2005/0116480 A1 * 6/2005 Deng et al. ..... 292/289
2006/0248931 A1 * 11/2006 Boulard et al. ..... 70/208

* cited by examiner

VENDING MACHINE LOCK ASSEMBLY

CROSS-REFERENCE TO RELATED APPLICATIONS

This application claims the benefit of priority from U.S. Provisional patent application Ser. No. 60/655,724, filed Feb. 24, 2005, the entire content of which is incorporated herein by reference.

BACKGROUND OF THE INVENTION

1. Field of the Invention

The present invention relates to vending machine locks.

2. Description of Related Art

Prior art vending machine locks have been known to be subject to vandalism, for example, by drilling. In addition, many of the prior art vending machine locks provide poor access control. Several other shortcomings also exist. It is therefore an object of the present invention to provide an improved vending machine lock.

SUMMARY OF THE INVENTION

According to an aspect of the invention, a wireless lock assembly is provided. The lock assembly includes a latch assembly that includes a wireless, electrically operated latching component, and a manually movable latching component. The wireless, electrically operated latching component is movable between activated and inactivated positions. The electrically operated latching component will remain in the activated position for a predetermined period of time, after which it will return to the inactivated position. The lock assembly also includes a handle assembly that is manually movable from a non-enabled position into an enabled position when the electrically operated latching component is moved to its activated position. When the handle assembly is in its enabled position, it can be manually moved so as to move the manually movable latching component from a locking condition to a releasing condition. The handle assembly can be manually moved from its non-enabled position to its enabled position by manual engagement and depression of an exposed surface portion thereof.

According to an aspect of the invention, a wireless lock assembly for being mounted on a vending machine door and for locking the vending machine door to a vending machine body is provided. The wireless lock assembly includes a latch assembly that includes a wireless, electrically operated latching component, and a manually movable latching component. The manually movable latching component includes a bolt that is engageable with a bolt receiver to be carried by the vending machine body. The lock assembly also includes a handle assembly that includes a handle portion. The handle assembly is manually movable between a non-enabled position in which the handle portion is retracted, and an enabled position in which the handle portion is extended. When the handle portion is extended, it can be manually engaged and moved in a predetermined manner. The handle portion is operatively connected with the manually movable latching component so that manual movement of the handle component in the predetermined manner will operate to move the bolt in a disengaged relation with the bolt receiver. The handle portion can be manually moved from being retracted to being extended when the electrically operated latching component has been actuated. The handle portion is retained in said retracted position by a detent and is moved to the extended position by a spring in response to manual release of the detent.

According to an aspect of the invention, a wireless lock assembly is provided. The wireless lock assembly includes a latch assembly that includes a wireless, electrically operated latching component, and a manually movable latching component. The lock assembly also includes a handle assembly that has a manually engageable portion. The manually engageable portion is manually rotatable to generate rotational movement of the manually movable latching component from a locking condition to a releasing condition after the electrically operated latching component is wirelessly activated. The manually engageable portion is formed from hardened steel and is devoid of any key hole or key contacting region.

According to an aspect of the invention, a wireless lock assembly is provided. The lock assembly includes a latch assembly that includes a solenoid and a wireless signal receiving circuit which operates the solenoid. The latch assembly further includes a manually movable locking bolt. The solenoid is movable from an inactivated position to an activated position for a predetermined period of time upon receipt of a signal from the circuit, after which the solenoid returns to the inactivated position. The lock assembly also includes a handle assembly that includes a detent and a manually engageable portion. The detent normally retains the manually engageable portion in a non-enabled position and the detent permits the manually engageable portion to be manually moved to an enabled position when the solenoid is moved to its activated position. When the manually engageable portion is moved to the enabled position, it can be manually rotated so as to move the locking bolt from a locking condition to a releasing condition. The manually engageable portion can be manually moved from its non-enabled position to its enabled position by manual engagement and depression thereof.

According to an aspect of the invention, a wireless lock assembly is provided. The lock assembly includes a latch assembly that includes a solenoid and a wireless signal receiving circuit which operates the solenoid. The latch assembly further includes a manually movable locking bolt. The solenoid is movable from an inactivated position to an activated position for a predetermined period of time upon receipt of a signal from the circuit, after which the solenoid returns to the inactivated position. The lock assembly also includes a handle assembly that includes a solenoid engaging portion and a manually engageable portion. The solenoid engaging portion is configured to receive a portion of the solenoid to normally retain the manually engageable portion in a non-enabled position and the manually engageable portion is configured to be manually moved to an enabled position when the solenoid is moved to its activated position. When the manually engageable portion is moved to the enabled position, it can be manually rotated so as to move the locking bolt from a locking condition to a releasing condition. The manually engageable portion can be manually moved from its non-enabled position to its enabled position by manual engagement and depression thereof.

These and other aspects, features, and advantages of the invention will become apparent from the following detailed description when taken in conjunction with the accompanying drawings, which are part of this disclosure and which illustrate, by way of example, the principles of this invention.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION

Figure 1:
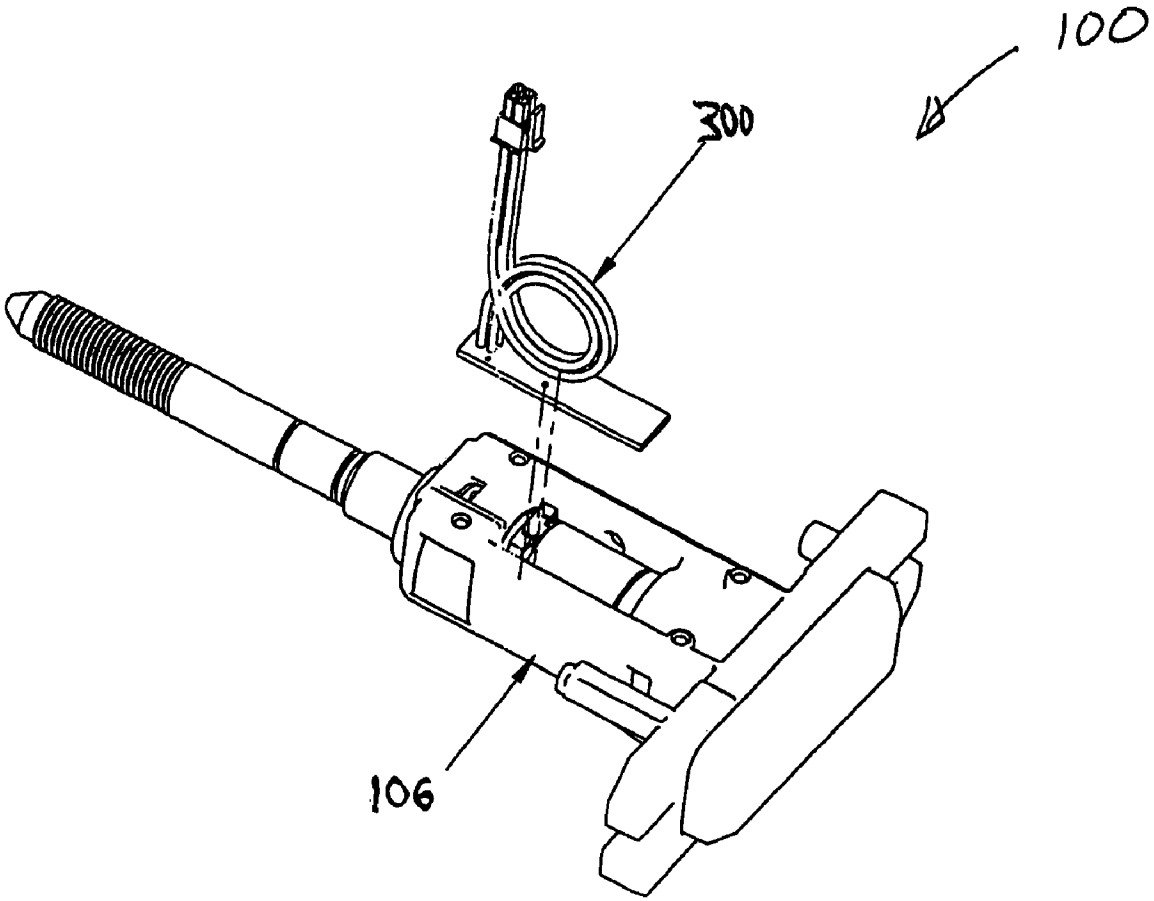
FIG. 1 is a perspective view of the lock assembly of the present invention.

The lock assembly 100 according to an embodiment of the present invention comprises, among other components, a latch assembly 102 and a handle assembly 104.

The latch assembly 102 includes a steel case shell 106, which houses a solenoid assembly 108. The solenoid contains coil windings, which, when energized, creates an electromagnetic field that drives an internal plunger 111 (see FIG. 7) that extends through the middle of the coil windings. The distal end of the internal plunger 111 mates with a plastic plunger attachment 110. The plunger 111 and plunger attachment 110 both have a central aperture.

Figure 3:
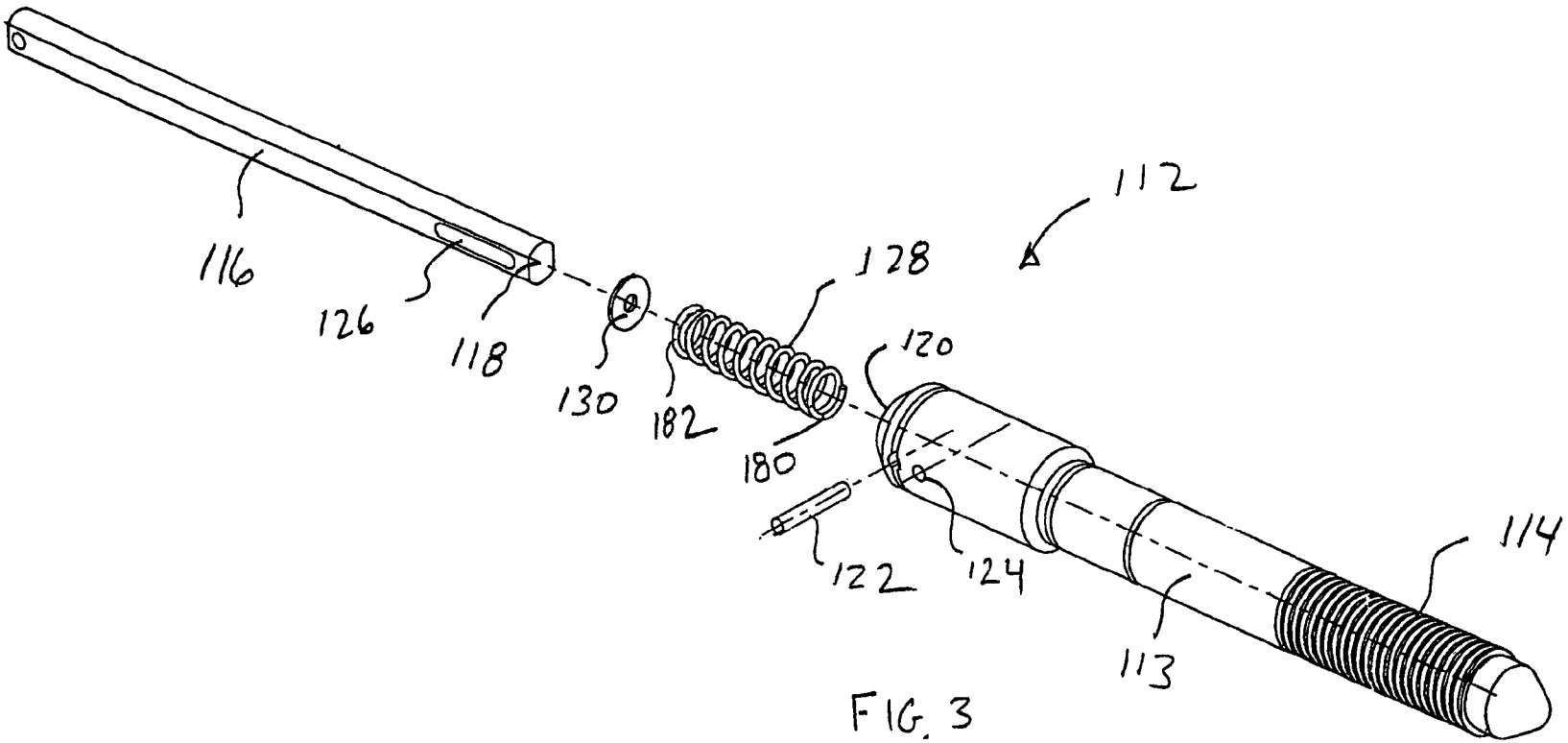
FIG. 3 is an exploded view of a threaded locking bolt assembly of the present invention.

A locking bolt assembly 112, shown in greater detail in FIG. 3, is in the form of an assembly that includes a bolt portion 113 having threads 114, and a driver portion 116. End portion 118 of the driver portion 116 is received within an axial opening (not shown) in end 120 of bolt portion 113. A pin 122 is received in an opening 124 in a side portion of the bolt portion 113. The pin 122 extends through a slot 126 in end portion 118 of driver portion 116. The driver portion 116, at certain operation points, is permitted to move longitudinally, relative to the bolt portion 113. The movement is limited by the length of slot 126, which receives the pin 122. A coil spring 128 biases the driver portion 116 away (to the left in FIG. 3) from the bolt portion 113. A spacer 130 prevents the end portion 118 from entering into and binding with coil spring 128.

Figure 4:
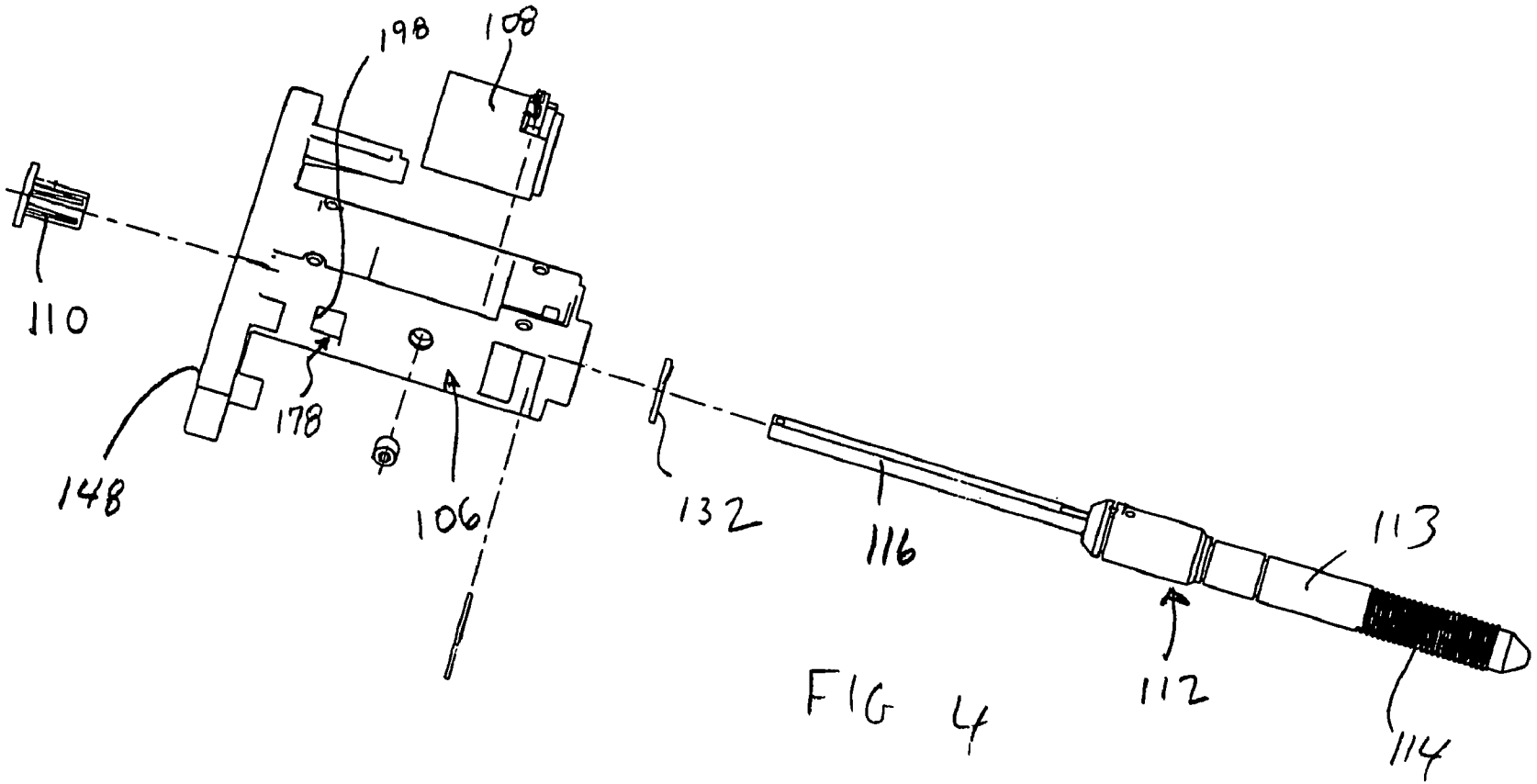
FIG. 4 is an exploded view of various components of the latch assembly of the present invention.

The driver portion 116 has a "double D" cross-sectional configuration and extends through a central aperture in a nylon washer 132 (see FIG. 4), and through the central aperture in the aforementioned plunger 111 and plunger attachment 110. The nylon washer 132 is in the assembly to create a gap between the plunger 111 and the bolt 113. The bolt is ferrous, so when the plunger 111 is magnetized (solenoid is powered) it tends to be attracted to the bolt rather than the solenoid assembly 108 without the washer. The plunger 111 is not attached to any other component and is allowed to travel axially along the driver 116.

Figure 5:
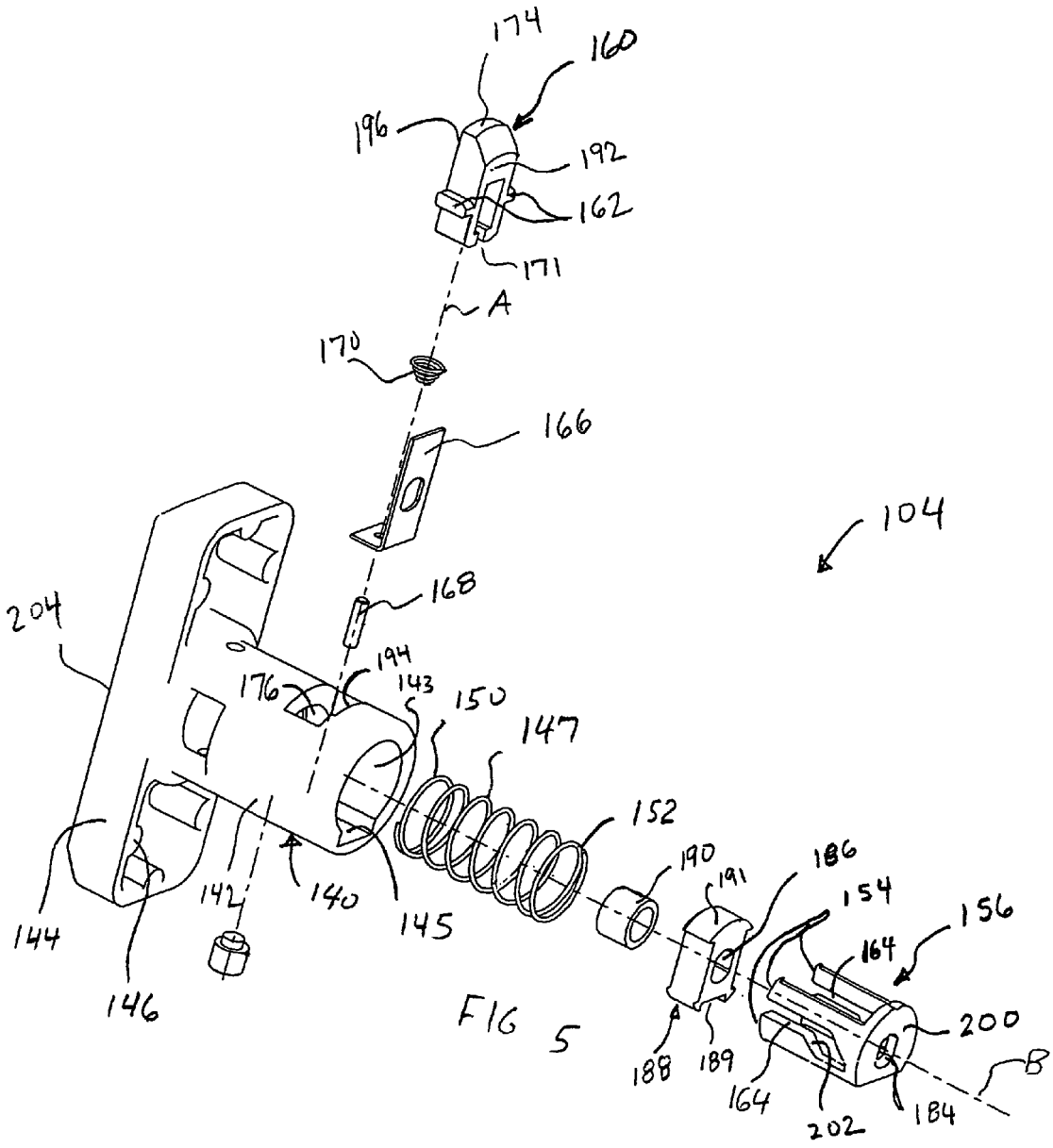
FIG. 5 is an exploded view of various components of the handle assembly of the present invention.

As best seen in FIG. 5, the handle assembly 104 includes a main handle member 140, which is made from hardened steel. Subsequent to hardening, the steel is chrome finished for aesthetic purposes, as it will constitute essentially the only showing surface when the bolt assembly is in a locking configuration with a vending machine door. The handle member 140 has a generally "T" shaped configuration, with a stem portion 142 and a hand engaging portion 144. The stem portion 142 is received within a front bore 149 of the case shell 106, and has an underside surface 146 that is slightly spaced from a front surface 148 of the case shell 106 that surrounds the front bore 149 (see FIG. 6).

The stem portion 142 of the handle member 140 is essentially cylindrical and hollow in shape and defines an opening 143, with a flattened internal surface portion 145, as shown in FIG. 5.

The stem portion 142 carries therein a cam spring 147, having one end 150 bearing against an inner surface of the handle member 140, and an opposite end 152 bearing against end surfaces 154 of a cam member 156. The stem portion 142 also contains a detent member 160. As will be described, the detent member 160 is capable of limited movement in a direction along axis A in FIG. 5, which is perpendicular to the lock axis B. The detent member 160 has side flanges 162, which are received in slots 164 of cam member 156. The detent member 160 is slidably mounted relative to a detent clip 166, which is secured inside the stem portion 142 by a dowel pin 168. The dowel pin 168 also extends through the center of a coil spring 170 and a lower opening 171 in the detent member 160. The coil spring 170 biases the detent member 160 upwards in FIG. 5, although movement of the detent member 160 along axis A when the handle assembly 104 is at rest is prevented due to engagement of the side flanges 162 in slots 164.

Figure 6:
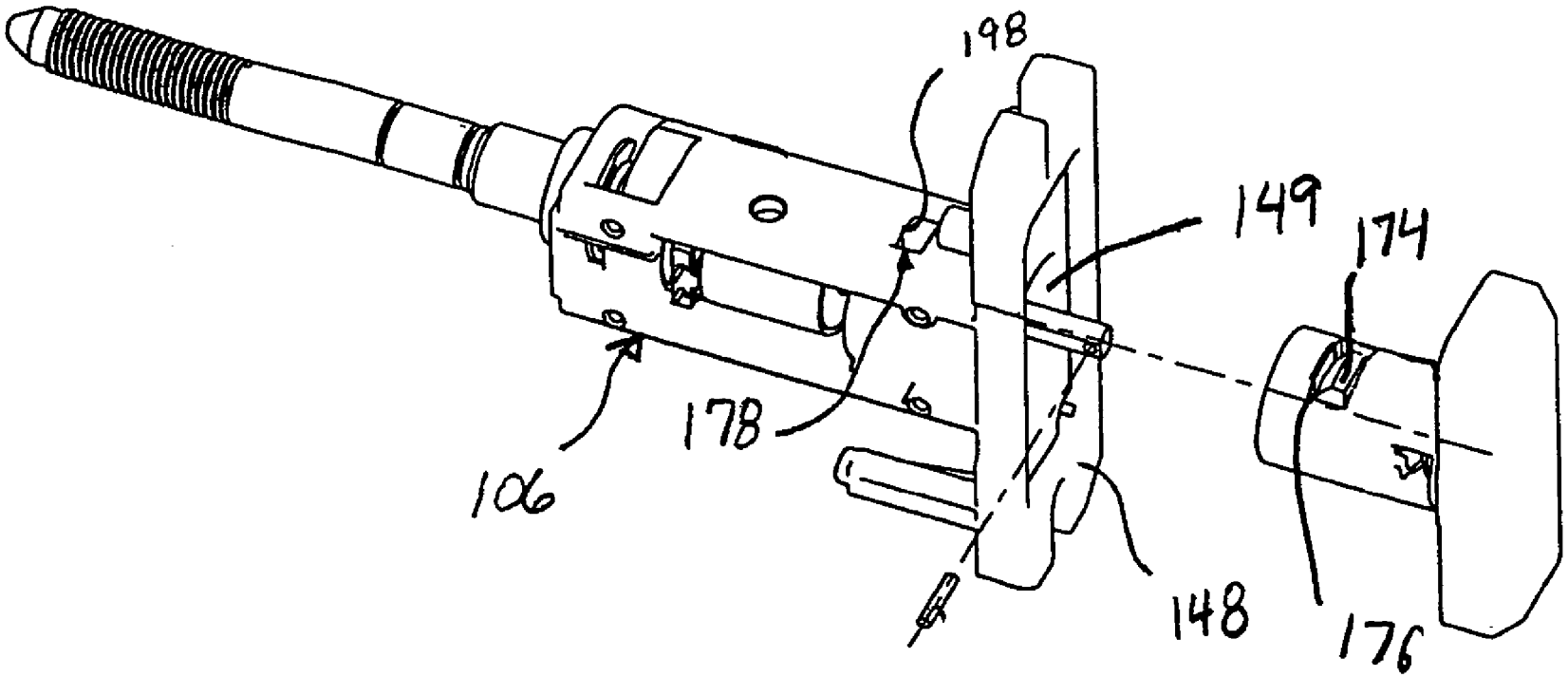
FIG. 6 is another exploded view of various components of the lock assembly of the present invention.

When the lock assembly 100 is at rest in a locking configuration, an upper end 174 of the detent member extends through a side opening 176 in stem portion 142, and at least partially extends through an aligned opening 178 in the case shell 106 (see FIG. 6).

In addition, when the lock assembly 100 is at rest in a locking condition, the threads 114 of bolt portion 113 threaded to receiving threads within the vending machine to prevent axial movement of the bolt portion 113, and to lock the door that carries the lock assembly 100. The coil spring 128 (see FIG. 3), which bears at one end 180 thereof against the axially fixed bolt portion 113 and at the other end 182 against spacer 130, and hence end portion 118, has the effect of biasing the driver portion to the left in FIG. 3, into the opening 143 and against the inner surface of the handle engaging portion 144. More specifically, the driver portion 116 extends through opening 184 in cam member 156 (see FIG. 5), opening 186 of insert 188, through nylon spacer 190, through the coils of cam spring 147, and into opening 143 so as to bear against an inner surface of the handle engaging portion 144. Thus, the driver portion 116 applies a biasing force to handle member 140 along axis B, toward the left in FIG. 3 when the lock assembly 100 is at rest. This biasing force results in back region 192 of the detent member 160 frictionally bearing against side surface 194 on the proximate side defining the side opening 176 in stem portion 142. As a further result, upper front region 196 of the detent member 160 frictionally bears against the side surface 198 on the distal side defining the side opening 178 in case shell 106.

Figure 2:
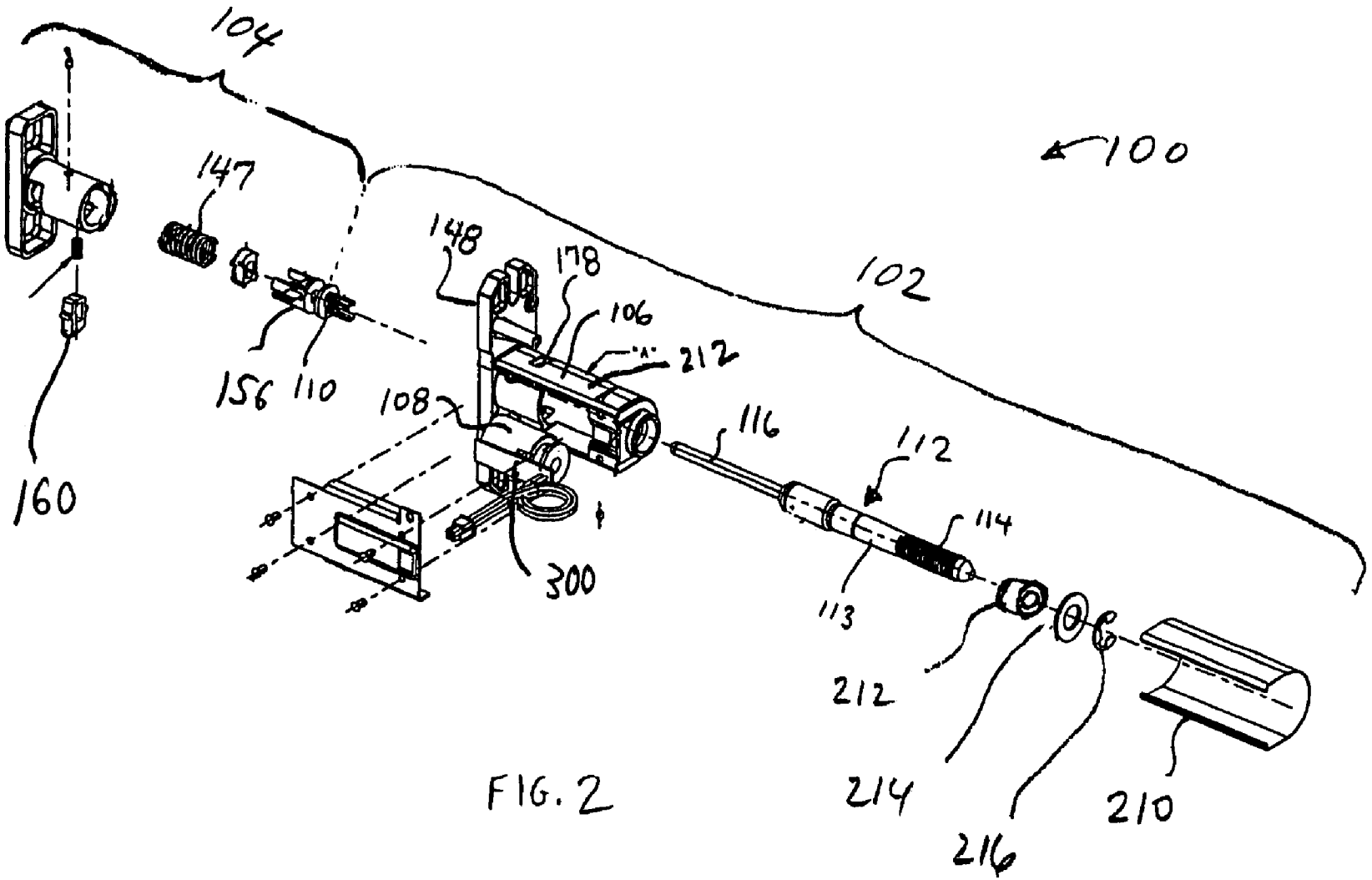
FIG. 2 is an exploded view of the lock assembly of the present invention.

When the solenoid assembly 108 is activated, it forces the plunger 111, and hence plunger attachment 110, to the left in FIG. 2. The plunger attachment 110 will thus be forced against end surface 200 of cam member 156, causing the cam member 156 to move to the left in FIG. 5 until the side flanges 162 reach the portion of slot 164 which transitions into cam ramp 202. At this point, the frictional forces applied to regions 192 and 196 of detent member, combined with the force of coil spring 170, prevents the detent member 160 from moving downwards along axis A, and hence prevents the cam member 156 from moving further to the left.

At this point, the user may elect to manually engage the front surface 204 (see FIG. 5) of the handle member 140 (which is normally essentially flush with the front surface of the vending machine door) to force the handle member 140 to the right against the force of spring 128, causing the driver portion 116 to move further into the opening 120 in the bolt portion 113, with pin 122 riding in slot 126 (see FIG. 3).

As a result of handle member 140 being manually forced inwards (towards the right in FIG. 5), the detent 160 is carried therewith so as to be moved to the right in FIG. 5 so that front region 196 is moved off of surface 198 of case shell 106 to release the frictional engagement therebetween, and with enough force so that the side flanges 162 are forced to ride down the cam ramp 202, against the bias of coil spring 170.

The detent member 160 is moved down sufficiently so that the upper end 174 thereof moves out of locking engagement with the side surface 198 in the side opening 178 of case shell 106. When the handle member 140 is released, the detent member 160 rides back up the ramp, but not enough to allow it to engage the slot in the case. With the solenoid assembly powered, the plunger attachment 110 remains displaced keeping the cam 156 displaced as the handle 140 is released. This minimizes the travel of the detent on the ramp sufficiently to keep it from re-locking as the handle is opened.

When manual inward force to the handle member 140 is released, the detent member 160 remains down (it does start to move back "up," but not enough to engage the case) and the handle member is pushed outwardly along axis B (to the left in FIG. 5) so as to protrude sufficiently beyond the case shell 106 and front surface of the vending machine door to enable the hand engaging portion to be manually grasped, with fingers reaching under the underside surface 146.

The user is then able to rotate the handle member 140 in a counterclockwise direction. This rotation is translated to the locking bolt 112, through the insert 188. Specifically, the peripheral configuration of insert 188 cooperates with the inner surface configuration of handle stem portion 142, with one end 189 of the insert 188 (the lower end in FIG. 5) being received in the flattened surface region 145 of the stem portion interior and the opposite end 191 mating with the cylindrical inner surface region of the stem portion interior. Thus, rotation of handle member 140 rotates the insert 188. In addition, the opening 186 in the insert 188 has a "double-D" configuration mating with the "double-D" configuration of the bolt driver portion 116 to cause rotational movement of the driver portion 116 and hence bolt portion 113, through the pin 122 and slot 126 connection therebetween. Rotation of bolt portion 113 enables the threads 114 thereof to become disengaged with the cooperating threads within the body of the vending machine to enable the bolt 113 to become released from locking engagement. Thus, the vending machine door can then be opened.

In one embodiment, an anti-drill protective sleeve 210 (shown in FIG. 2) at least partially surrounds a stem portion 212 of casing 106. The protective sleeve 210 is made from a hardened steel, such as SAE 1090 or 1095 that substantially prevents vandalism by someone attempting to drill through the lock assembly from the side of the unit. The detent 160 is the primary component protected by the sleeve 210. A micro-circuit 300, discussed in further detail below, and the solenoid assembly 108 also receive additional protection. In addition, the hardened steel of front surface 204 of the handle member 140 prevent drilling from the front of the unit.

A bolt spring 212, washer 214, and e-clip 216 are placed on the assembly to absorb the energy imparted to the entire assembly when the door is "slammed closed." As the door of a vending machine is closed, the bolt 112 is forced into engagement with its mating nut on the body of the machine. The impact of this collision can be substantial depending on the velocity imparted to the door. To negate this energy, the design allows the bolt relative movement to the case along its axis. As this movement occurs, the e-clip 216 attached to the bolt 112 presses against a washer 214 which in turn compresses a spring 212 against the end of the case. Ultimately the kinetic energy generated by the impact is converted to potential energy in the spring 212, keeping the energy dissipation from occurring in the other components of the assembly.

Figure 7:
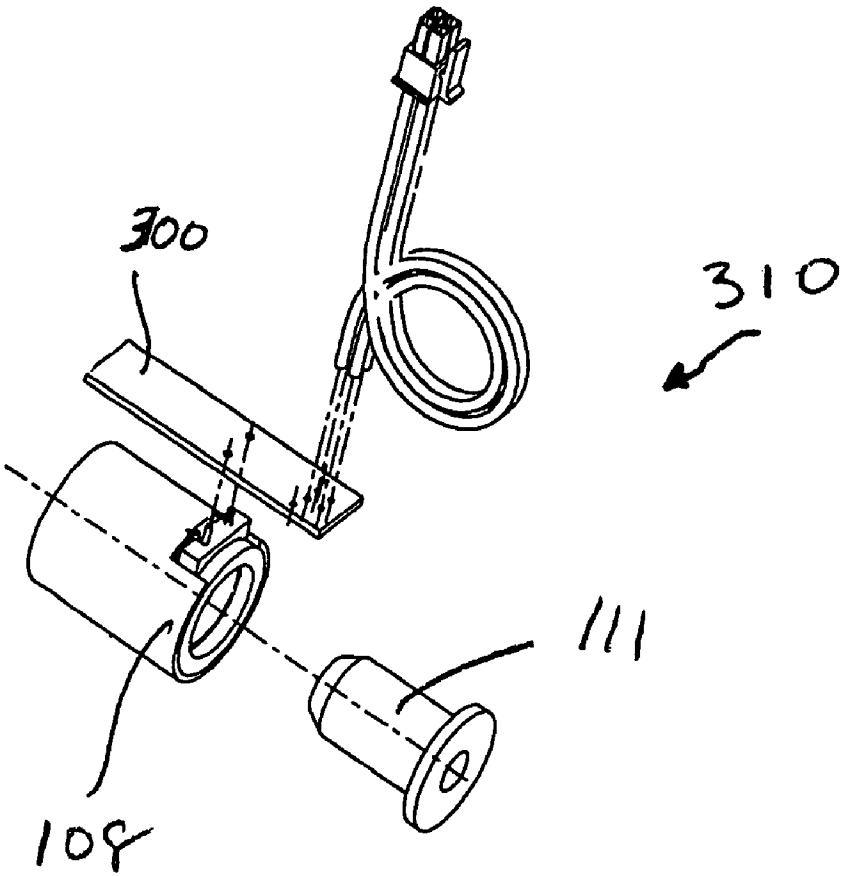
FIG. 7 is an exploded view of an electrically operated latching component of the present invention.

In one embodiment, the solenoid assembly 108 is operated upon an appropriate electrical signal received from a wireless micro-circuit 300 which is electrically communicated with the solenoid. The solenoid assembly 108 and wireless micro-circuit 300 together form an electrically operated latching component 310, as shown in FIG. 7. The wireless micro-circuit 300 has a wireless signal receiver and will energize the solenoid assembly 108 when it receives a predetermined wireless signal to which it is programmed to receive from a remote control transmitter device that can be carried by service personnel.

In one embodiment, the micro-circuit 300 maintains the solenoid assembly 108 energized for a predetermined period of time, such as 8-15 seconds, and more preferably 10 seconds. As a result, if within this predetermined period the operator does not apply manual force to the front surface 204 of the handle member 140, the operator will not subsequently be able to manually release the lock unless the solenoid is re-energized again. That is, when the solenoid is energized, the cam member 156 is axially forced along axis B by the solenoid plunger. The cam member moves so that the slots 164 are positioned such that the side flanges 162 are at intersection of the slots 164 and cam ramp 202. In this position, the lock assembly is not unlocked, but is in a position that enables manual unlocking by pushing the front surface 204 inwards so that the detent member 160 is moved towards the solenoid and the side flanges 162 are forced along cam ramp 202 so as to move the detent member 160 inwards relative to the handle member 140, along axis A, into the unlocking position thereof. However, if the front surface 204 of the handle member 140 is not pushed in within the predetermined period of time during which the solenoid remains activated (e.g., 8-15 seconds), then the solenoid will return to its original state, and the cam member 156 will move therewith so that the side flanges 162 are positioned closer towards the open end of the slots 164, away from cam ramp 202. Thus, manual force applied to front surface 204 after the predetermined activation period will have no effect on the lock assembly 100. As a result, inadvertent actuation of the solenoid by service personnel (e.g., when leaving the vending machine) will not enable unlocking of the lock assembly by the public because the lock assembly 100 will automatically return to a state in which it cannot be manually unlocked with a short time period.

Figure 8:
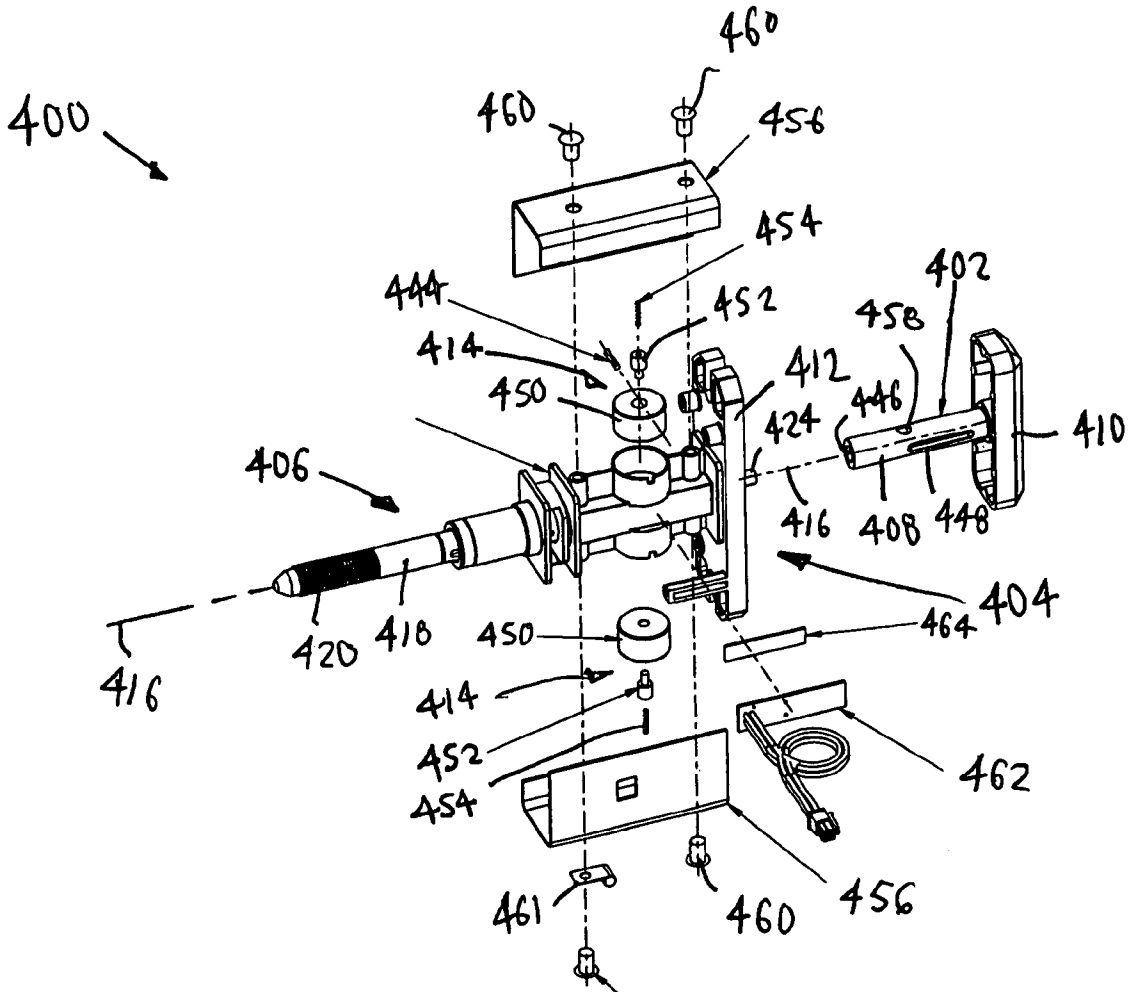
FIG. 8 is an exploded view of another embodiment of a lock assembly of the present invention.
Figure 9:
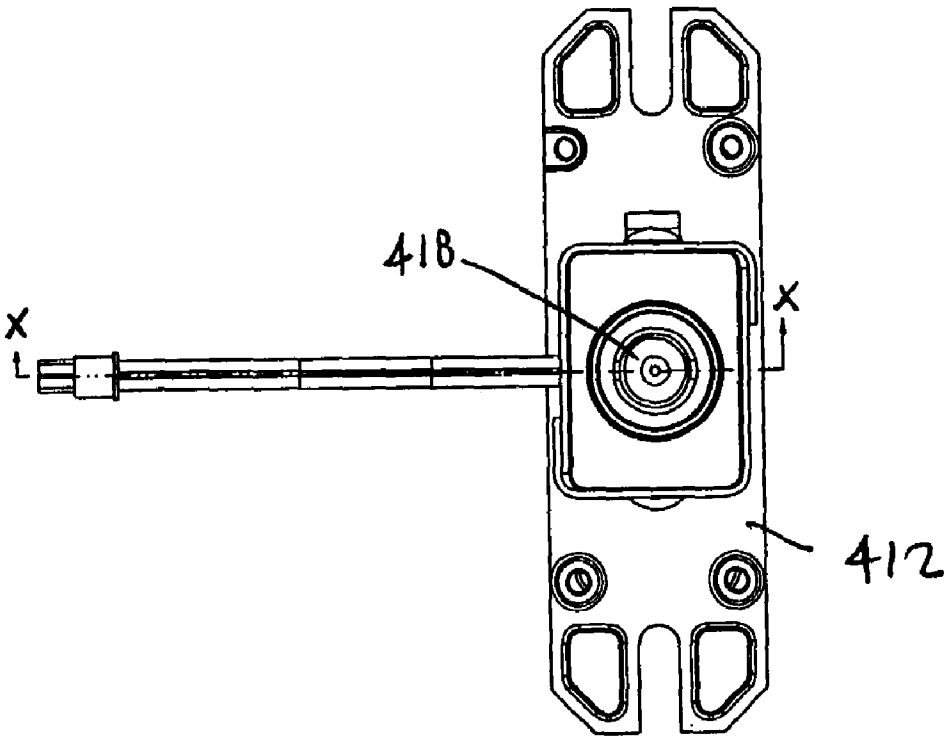
FIG. 9 is an end view of the lock assembly of FIG. 8.

Another embodiment of a lock assembly 400 is shown in FIGS. 8-11. As shown in FIG. 8, the lock assembly 400 includes a handle 402, a latch assembly 404, and a locking bolt assembly 406.

The handle 402 is preferably made from hardened steel, and may have a chrome finish. The handle 402 has a generally "T" shaped configuration, with a stem portion 408 and a hand engaging portion 410, as shown in FIG. 8. The hand engaging portion 410, which may also be referred to as a manually engageable portion, is configured to be received by a person's hand, as will be discussed in greater detail below.

The latch assembly 404 includes a case shell 412 that is configured to receive a pair of solenoids 414. The solenoids 414 are disposed on opposite sides of a longitudinal axis 416 that extends through the case shell 412. The case shell 412 receives the stem portion 408 of the handle 402 at one end, and the locking bolt assembly 406 at an opposite end, as shown in FIG. 8.

Figure 10:
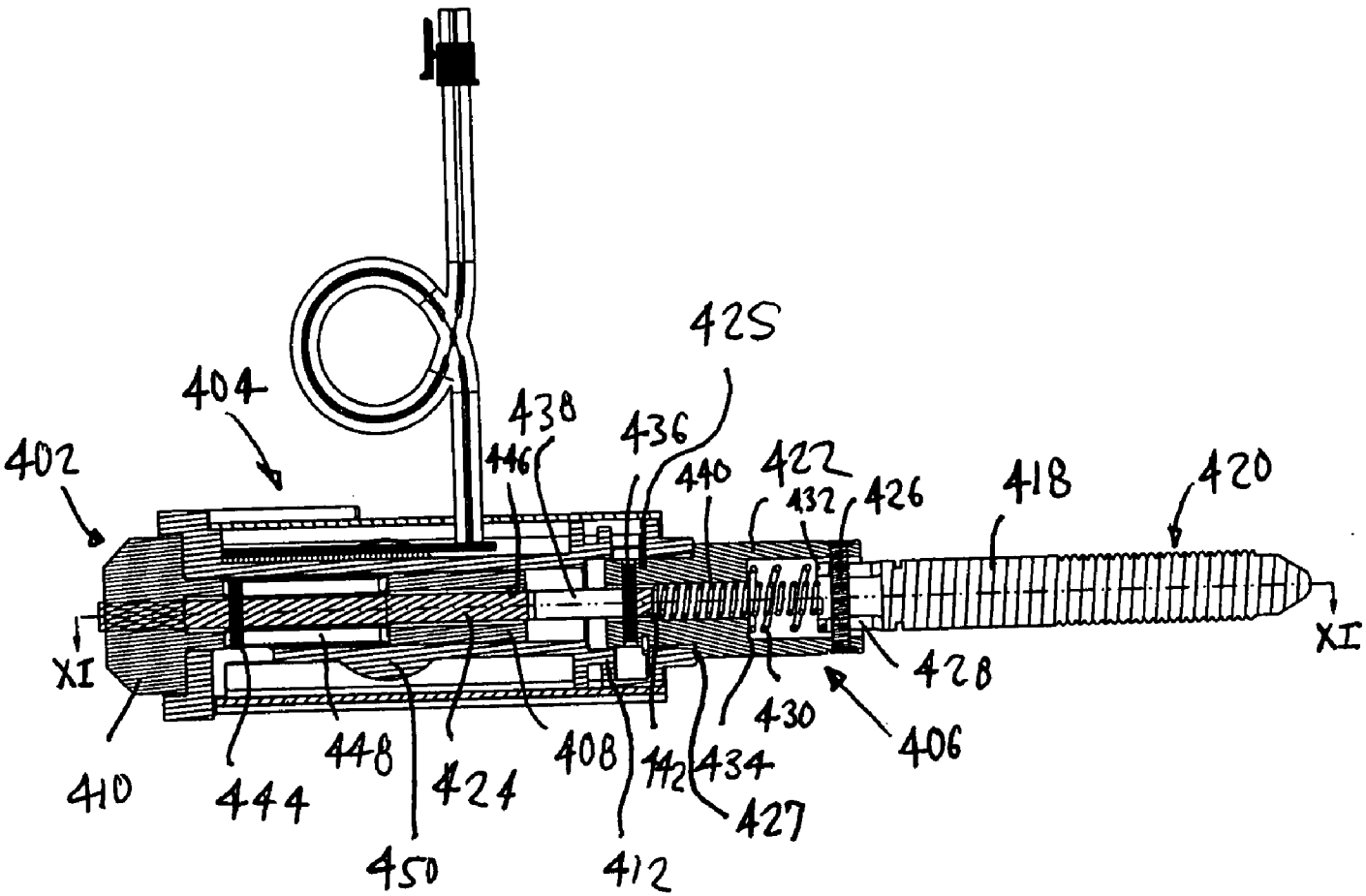
FIG. 10 is a cross-sectional view of the lock assembly of FIG. 9 taken along line X-X.
Figure 11:
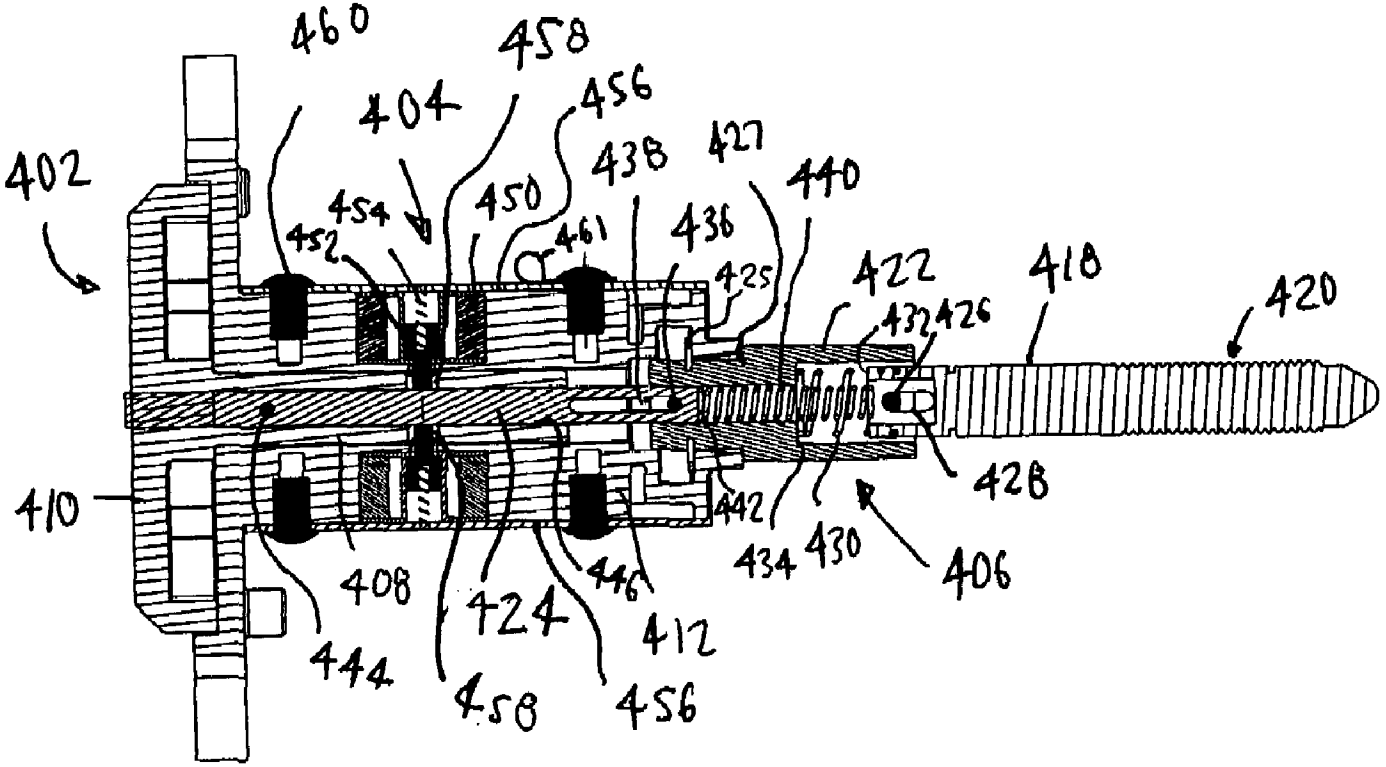
FIG. 11 is a cross-sectional view of the lock assembly of FIG. 10 taken along line X1-X1.

The locking bolt assembly 406 includes a bolt 418 that has threads 420 on an exterior surface thereof, and a coupler 422 that is connected to the bolt 418 at one end and to a driver 424 at an opposite end. The coupler 422 and the case shell 412 are constructed and arranged so that the coupler 422 may be connected to the case shell 412 with a clip 425. As shown in FIGS. 10 and 11, the case shell 412 and the coupler 422 are configured such that the coupler 422 is received by the case shell 412 via an opening in the case shell 412, and is positioned relative to the case shell 412 via a shoulder 427. The clip 425 secures the coupler 422 so that the coupler 422 is fixed in the axial direction, i.e., along the longitudinal axis 416, but may rotate about the longitudinal axis 416.

As shown in FIGS. 10 and 11, the bolt 418 is received by the coupler 422 and is connected to the coupler 422 via a pin 426 that extends from one outer surface of the coupler 422, through a slot 428 in the bolt 418, and to the opposite outer surface of the coupler 422. This configuration allows the bolt 418 to move a limited distance, i.e., the length of the slot 428, relative to the coupler 422 along the longitudinal axis 416, and also allows the bolt 418 to rotate about the longitudinal axis 416 with the coupler 422. A spring 430 may be disposed between one end 432 of the bolt 418 and an interior surface 434 of the coupler 422, as shown in FIGS. 10 and 11, so that the bolt 418 may be biased outward from the coupler 422.

The driver 424 may be connected to the coupler 422 via a pin 436. As shown in FIGS. 10 and 11, the pin 436 may extend from one outer surface of the coupler 422, through a slot 438 in the driver 424, and to the opposite outer surface of the coupler 422. This configuration allows the driver 424 to move a limited distance, i.e., the length of the slot 438, relative to the coupler 422 along the longitudinal axis 416. As shown, a spring 440 may be disposed between one end 442 of the driver 424 and the end 432 of the bolt 418, so that the driver 424 may be biased away from the bolt 418.

The handle 402 may be connected to the driver 424 via a pin 444, as shown in FIGS. 10 and 11. As shown, the handle 402 receives the driver 424 in an opening 446 (see FIG. 8) in the stem portion 408 of the handle 402 such that at least a portion of the driver 424 is contained within the handle 402 after assembly. The pin 444 may extend through the driver 424 and be received by a slot 448 in the stem portion 408 of the handle 402 so that the handle 402 may move relative to the driver 424, as discussed in further detail below.

Each solenoid 414 includes a coil 450, a plunger 452, and a spring 454. The spring 454 biases the plunger 452 outward from the coil 450. When the coil 450 is energized, which will be discussed in further detail below, the plunger 452 overcomes the bias of the spring 454 and retracts into the coil 450. As described above, each solenoid 414 is placed in the case shell 412. A casing 456 may be used to cover the solenoids 414 and a substantial portion of the case shell 412. The casing 456 may be a single piece, or may be a plurality of pieces, as shown in FIG. 8. A plurality of fasteners 460 may be used to connect the casing 456 to the case shell 412. As shown in the Figures, a strain relief device 461 may be positioned between one of the fasteners 460 and the casing 456.

Each plunger 452 is configured to engage a solenoid engaging portion 458 in the stem portion 408 of the handle 402, thereby locking the handle 402 in a locked position relative to the case shell 412. The solenoid engaging portion may be a recess, or an opening. The illustrated embodiment is not intended to be limiting in any way. When the coils 450 are initially energized, the plungers 452 may not be able to retract into the coils 450 because of a shear force that is present between the plungers 452 and the stem portion 408 of the handle 402, due to the biasing force of the spring 440 on the driver 424 and handle 402. Pushing the handle 402 against the bias of the spring 440 relieves the shear force, thereby allowing the plungers 452 to retract into the coils 450.

Once the plungers 452 have disengaged from the solenoid engaging portions 458, the hand engaging portion 410 of the handle 402 may be grasped by the user and pulled outward and away from the case shell 412 so that the user may then more easily rotate the handle 402, thereby causing rotation of driver 424, the coupler 422, and the bolt 418. The handle 402 may be rotated until the bolt 418 unscrews from the remainder of the vending machine. Once the bolt 418 has been unscrewed, the door of the vending machine may be opened. To relock the vending machine, the user may close the door, grasp the handle 402, rotate the handle 402 so that the bolt 418 reengages the matching threads in the machine and secure the door in a closed position. When the bolt 418 is fully reengaged, the solenoid engaging portions 458 in the stem portion 408 of the handle realign with the plungers 452 of the solenoids 414 that are no longer energized. The biasing force of the springs 454 on the plungers 452 move the plungers 452 to engage the solenoid engaging portions 458, thereby locking the handle 402 in place.

In an embodiment, the solenoids 414 may be energized upon an appropriate signal received from a wireless micro-circuit 462. The micro-circuit 462 may be attached to the case shell 412 with an adhesive 464, as shown in FIG. 8, or with any other appropriate connector. The micro-circuit 462 has a wireless signal receiver that is configured to energize the solenoids when it receives a predetermined wireless signal to which it is programmed to receive from a remote control transmitter device that can be carried by service personnel, i.e. the aforementioned "user.'

In an embodiment, the micro-circuit 462 maintains the solenoids 414 in an energized state for a predetermined period of time, such as 8-15 second, and more preferably 10 seconds. As a result, if within this predetermined period of time the user does not apply the manual force to the handle 402 to relieve the shear force between the plungers 452 and the solenoid engaging portions 458 in the stem portion 408 of the handle 402, the user will not subsequently be able to manually release the bolt 418 unless the solenoids are re-energized again. This ensures that the lock assembly 400 will relock in a short period of time, even if the user accidentally energized the solenoids 414. Many of the tamper resistant attributes described above may also be used in the lock assembly 400 shown in FIGS. 8-11.

The scope of the present invention is not limited to the above described non-limiting embodiments, but is encompassed by the following claims and equivalents.

What is claimed is:

1. A wireless lock assembly, comprising:

a latch assembly including a wireless, electrically operated latching component, and a manually movable latching component;

said wireless, electrically operated latching component being movable between activated and inactivated positions, and wherein said electrically operated latching component will remain in said activated position for a predetermined period of time, after which it will return to the inactivated position;

a handle assembly being manually movable from a non-enabled position into an enabled position when said electrically operated latching component is moved to its activated position, and wherein when the handle assembly is in its enabled position, it can be manually moved so as to move said manually movable latching component from a locking condition to a releasing condition, wherein the handle assembly can be manually moved from its non-enabled position to its enabled position by manual engagement and depression of an exposed surface portion thereof.

2. A wireless lock assembly according to claim 1, wherein said manually movable latching component comprises a threaded bolt assembly.

3. A wireless lock assembly according to claim 1, wherein said exposed surface comprises a hardened steel structure.

4. A wireless lock assembly according to claim 1, wherein said wireless, electrically operated latching component includes a wireless signal receiving circuit and a solenoid device.

5. A wireless lock assembly according to claim 4, wherein said wireless, electrically operated latching component further includes a second solenoid device.

6. A wireless lock assembly according to claim 5, wherein said solenoid devices are located on opposite sides of said handle assembly.

7. A wireless lock assembly according to claim 4, wherein said handle assembly includes a detent, and wherein said detent can be moved to said enabled position when said electrically operated latching component is moved into its activated position.

8. A wireless lock assembly according to claim 7, wherein said handle assembly includes a manually engageable portion that has a T-shaped configuration and that provides said exposed surface.

9. A wireless lock assembly comprising:

a latch assembly including a solenoid and a wireless signal receiving circuit which operates said solenoid, said latch assembly further including a manually movable locking bolt;

said solenoid being movable from an inactivated position to an activated position for a predetermined period of time upon receipt of a signal from said circuit, after which said solenoid returns to said inactivated position;

a handle assembly including a solenoid engaging portion and a manually engageable portion, said solenoid engaging portion being configured to engage a portion of the solenoid to normally retain said manually engageable portion in a non-enabled position and said manually engageable portion being configured to be manually moved to an enabled position when said solenoid is moved to its activated position, wherein when said manually engageable portion is moved to said enabled position it can be manually rotated so as to move said locking bolt from a locking condition to a releasing condition, wherein the manually engageable portion can be manually moved from its non-enabled position to its enabled position by manual engagement and depression thereof.

10. A wireless lock assembly according to claim 9, wherein the latch assembly further includes a second solenoid, and wherein the handle assembly includes a second solenoid engaging portion configured to engage a portion of the second solenoid.

* * * * *